US005421578A

United States Patent [19]

Ames

[11] Patent Number: 5,421,578

[45] Date of Patent: Jun. 6, 1995

[54] GOLF PUTTING AND CHIPPING TRAINER AND DESK ACCESSORY DEVICE

[76] Inventor: Ronald Ames, 3313 Willow Knolls Rd., Apt. #8, Peoria, Ill. 61614

[21] Appl. No.: 232,948

[22] Filed: Apr. 25, 1994

[51] Int. Cl.[6] ..... A63B 69/36

[52] U.S. Cl. ..... 273/176 F; 273/178 R; 273/192; 273/184 A

[58] Field of Search ..... 273/177 R, 178 R, 178 A, 273/178 B, 179 R, 179 A, 179 B, 179 C, 179 D, 179 E, 180, 176 B, 176 F, 176 FA, 176 FB, 191 R, 192, 184 A

[56] References Cited

U.S. PATENT DOCUMENTS

| | | | |
|---|---|---|---|
| D. 77,107 | 12/1928 | Long . | |
| D. 81,286 | 6/1930 | Johnson . | |
| D. 124,409 | 12/1940 | Reichenbach . | |
| D. 130,014 | 10/1941 | Blatz . | |
| D. 137,949 | 5/1944 | Goldbert . | |
| D. 143,352 | 12/1945 | Post . | |
| D. 164,166 | 8/1951 | Griswold . | |
| D. 196,846 | 11/1963 | Niamtu, Jr. . | |
| D. 202,988 | 11/1965 | Suesens . | |
| D. 243,142 | 1/1977 | Chmela . | |
| D. 245,438 | 8/1977 | Thiel . | |
| D. 245,439 | 8/1977 | Thiel . | |
| D. 251,863 | 5/1979 | Gordon . | |
| D. 270,899 | 10/1983 | Huang . | |
| D. 273,126 | 3/1984 | Turza et al. . | |
| D. 333,858 | 3/1993 | Pitz . | |
| D. 340,964 | 11/1993 | Dunphy . | |
| 1,287,903 | 12/1918 | Daily . | |
| 1,545,648 | 7/1925 | Fletcher . | |
| 1,611,660 | 12/1926 | Manly . | |
| 2,084,901 | 6/1937 | Eisenberg . | |
| 2,118,326 | 5/1938 | Richardson, Jr. . | |
| 2,303,736 | 1/1942 | Hall . | |
| 2,463,798 | 5/1949 | Paisley . | |
| 2,597,413 | 5/1952 | Wall . | |
| 2,894,755 | 7/1959 | Scelzo, Jr. . | |
| 3,059,931 | 10/1962 | Garcia | 273/179 C X |
| 3,065,971 | 11/1962 | Coles . | |

(List continued on next page.)

FOREIGN PATENT DOCUMENTS 2020983 11/1979 United Kingdom .
2238249 5/1991 United Kingdom .

OTHER PUBLICATIONS

Pelz, Golf Magazine, Truth Board, p. 56, Dec. 1993.
Pro Carpet, Super Putting Practice Combo, Golfsmith Putting Track, Ad p. 25.
On-Trac Putting System, Golf Magazine, p. 46, Jan. '92.
Putting Tunnel, Golf Magazine, p. 46, Jan. '92.
Tru-Putt Trainer, Golf Magazine, p. 47, Jan. '92.
Putt-O-Plane, Golf Magazine, p. 47, Jan. '92.
Ping Stroke-in, Golf Magazine, p. 45, Jan. '92.
Stroke It, Golf Magazine p. 19, Feb. 1993.

*Primary Examiner*—George J. Marlo
*Attorney, Agent, or Firm*—Calvo & Wiemelt

[57] ABSTRACT

This invention provides a golf putting and chipping trainer and desk accessory device (10) for improving a golfer's putting and chipping stroke which can also be used as a desk accessory when not being used as a trainer. The device (10) includes a ramp (20) in combination with a base (40). The ramp (20) has a face (22), an under side (24), a first end (26) and a second end (28). The second end (28) substantially defines an apex (30). The base (40) is rectangular and includes a first side (42), a bottom side (44), and a top side (46) having an aperture (48) contained therein which simulates a golf cup. The first side (42) of the base (40) and the first end (26) of the ramp (20) have a first thickness (58) and are cooperatively engaged. When used as a desk accessory, one or more novelties (56) are mountable to the top side (46) of the base (40). The novelties (56) may be of any of a variety of ornamental or utilitarian articles. The face (22) of the ramp (20) may include a laser engraved-logo. The ramp (20) has an upward slope such that a golf ball (70) which is propelled toward the ramp (20) in line with the aperture (48) at a predetermined rate of speed would cease rolling at a point approximately 17 inches beyond the center of the aperture (48) if the trainer was not present.

16 Claims, 4 Drawing Sheets

U.S. PATENT DOCUMENTS

| | | | |
|---|---|---|---|
| 3,073,602 | 1/1963 | Bell . | |
| 3,104,108 | 9/1963 | Robertson . | |
| 3,273,891 | 9/1966 | Grim, Jr. . | |
| 3,275,325 | 9/1966 | MacKenzie | 273/179 C |
| 3,351,345 | 11/1967 | Robinette | 273/176 B |
| 3,424,464 | 1/1969 | Greenhouse . | |
| 3,471,155 | 10/1969 | Donaldson . | |
| 3,561,765 | 2/1971 | Dixon | 273/179 C X |
| 3,659,856 | 5/1972 | Fatur . | |
| 3,808,084 | 4/1974 | Doty . | |
| 3,857,570 | 12/1974 | Gutierrez | 273/187.6 X |
| 3,885,796 | 5/1975 | King . | |
| 3,899,180 | 8/1975 | Rodman . | |
| 3,936,055 | 2/1976 | Scott . | |
| 4,133,535 | 1/1979 | Marsh | 273/192 |
| 4,153,255 | 5/1979 | Woodson . | |
| 4,275,886 | 6/1981 | Bannon | 273/178 R |
| 4,334,684 | 6/1982 | Sterling . | |
| 4,413,824 | 11/1983 | King . | |
| 4,560,167 | 12/1985 | Perreau | 273/184 A |
| 4,573,686 | 3/1986 | Nakamats | 273/179 C X |
| 4,601,472 | 7/1986 | O'Flanagan | 273/163 R X |
| 4,725,063 | 2/1988 | Hoyt | 273/179 C |
| 4,842,280 | 6/1989 | Hilton . | |
| 4,927,153 | 5/1990 | Schaefer | 273/187 R |
| 5,072,943 | 12/1991 | Sindelar | 273/192 |
| 5,087,046 | 2/1992 | Mauch | 273/178 R |
| 5,092,603 | 3/1992 | Schindler | 273/194 A X |
| 5,152,534 | 10/1992 | Sindelar | 273/192 |

GOLF PUTTING AND CHIPPING TRAINER AND DESK ACCESSORY DEVICE

BACKGROUND OF THE INVENTION

The present invention relates generally to a new and improved golf putting and chipping trainer, and in particular to such a device which may also be used as an ornamental desk accessory, a utilitarian desk accessory, or both, while not being used as a trainer.

Numerous devices have heretofore been proposed for teaching proper putting form, and these have included devices having the object of improving the golf game by encouraging repetitious simulation of a putting stroke whereby the golfer's memory and motor nervous system are conditioned to consistently employ the desired putting stroke. For example, U.S. Pat. No. 3,471,155, issued to J. E. Donaldson on Oct. 7, 1969, discloses such a device. In addition, numerous prior art devices have attempted to combine golf related articles with desk sets. For example, U.S. Patent Des. 270,899 issued to Huang on Oct. 11, 1983, discloses an ornamental design for a combined clock and thermometer desk set. However, each of these devices have been wanting in one or more regard.

In Golf Magazine, December 1993, p. 56, Dave Pelz discloses that through research it has been determined that golfers will make the most putts if they hit the ball hard enough to propel it 17 inches past the cup. The invention of this application represents a recent innovation in the art incorporating the findings of Pelz into a device which overcomes the deficiencies of the prior art.

SUMMARY OF THE INVENTION

It is an object of the present invention to provide a golf putting and chipping trainer device which encourages guided and restricted golf club translation to develop a conditioned, subconscious, golfer memory and motor nervous response during the golf stroke which persists even when the device is not being used.

It is another object of the present invention to provide a golf putting and chipping trainer in accordance with the foregoing object which may also be used as an ornamental desk accessory, a utilitarian desk accessory, or both, while not being used as a trainer.

It is a further object of the present invention to provide a combination golf putting and chipping trainer device in accordance with the foregoing objects which also includes a laser-engraved logo.

It is still another object of the present invention to provide a golf putting and chipping trainer in accordance with the foregoing objects which includes a ramp having an upward slope such that a golf ball which is propelled toward the ramp in line with a simulated golf cup at a predetermined rate of speed would cease rolling at a point approximately 17 inches beyond the center of the simulated golf cup if the trainer was not present.

It is a yet another object of the present invention to provide a golf putting and chipping trainer in accordance with the foregoing objects which includes a self-contained putting surface.

It is still another object of the present invention to provide a golf putting and chipping trainer device in accordance with the foregoing objects which is adapted for use with different sized golf clubs.

It is yet another object of the present invention to provide a golf putting trainer device in accordance with the foregoing objects which is simple in design, inexpensive to manufacture, portable, lightweight, and which can be employed with any standard golf club.

A broad aspect of the invention involves a golf putting and chipping trainer and desk accessory device for improving a golfer's putting and chipping stroke which can also be used as a desk accessory when not being used as a trainer. The device includes a ramp in combination with a base. The ramp has a face, an under side, a first end and a second end. The second end substantially defines an apex. The base is rectangular and includes a first side, a bottom side, and a top side, as well as a hole simulating a golf cup. The first side of the base and the first end of the ramp have the same thickness and are cooperatively engaged. When used as a desk accessory, one or more novelties are mountable to the top side of the base. The novelties may be of any of a variety of ornamental or utilitarian articles.

A somewhat more limited aspect of the invention involves a golf putting and chipping trainer as set forth above which also includes a logo which is laser-engraved on the face of the ramp.

Another aspect of the present invention involves a golf putting and chipping trainer as set forth above which includes a ramp having an upward slope such that a golf ball which is propelled toward the ramp in line with a simulated golf cup at a predetermined rate of speed would cease rolling at a point approximately 17 inches beyond the center of the simulated golf cup if the trainer was not present. Specifically, the ramp has a $\frac{1}{8}$ inch thickness at one end and rises to a height of one inch at its other end. The length of the ramp is $6\frac{1}{2}$ inches and the base contains a simulated golf cup with a diameter of $3\frac{5}{8}$ inches which is set $2\frac{3}{4}$ inches on its center from the end of the ramp. The upward slope of the ramp is defined by an angle of approximately 7.668 degrees above horizontal.

A further aspect of the present invention involves a golf putting and chipping trainer as set forth above which includes a substantially planar, felt covered putting and chipping surface. The ramp and base are positioned, in combination, at one end of the surface with the apex of the ramp pointing toward the opposite end of the surface. In such arrangement a golf ball positioned on the surface may be struck by a golf club and propelled toward the ramp and in line with the simulated golf cup. The surface may also contain a pair of elongated guide members which receive a golf club intermediate therebetween and guide the club's translation during a golf stroke to encourage guided and restricted golf club translation to develop a conditioned, subconscious, golfer memory and motor nervous response during the golf stroke which persists even when the device is not being used. The elongated guide members may be moveable laterally and horizontally to provide putting practice from different lengths and employing different golf clubs.

Other objects, features, capabilities and advantages are comprehended by the invention, as will later appear and as are inherently possessed thereby.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
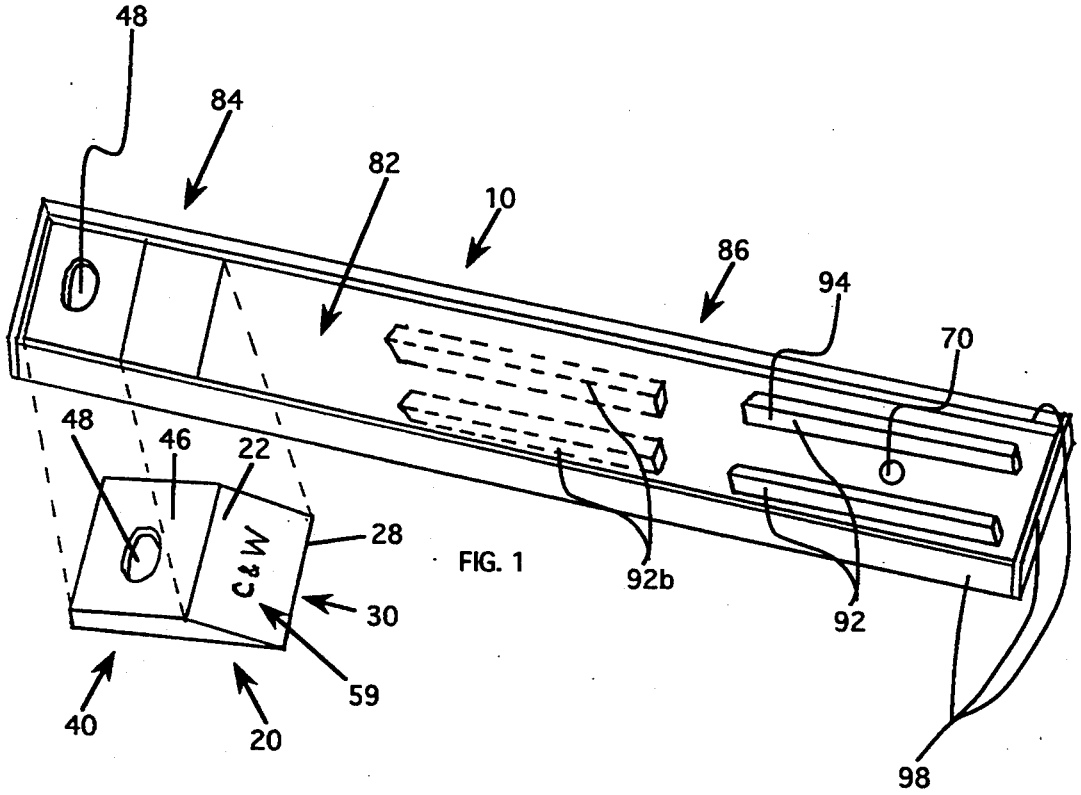
FIG. 1 is a perspective view of a golf putting and chipping trainer device constructed according to the principles of the present invention illustrating the cooperation between the surface and the combination ramp and base, and the elongated guide means in two different dispositions.
Figure 2:
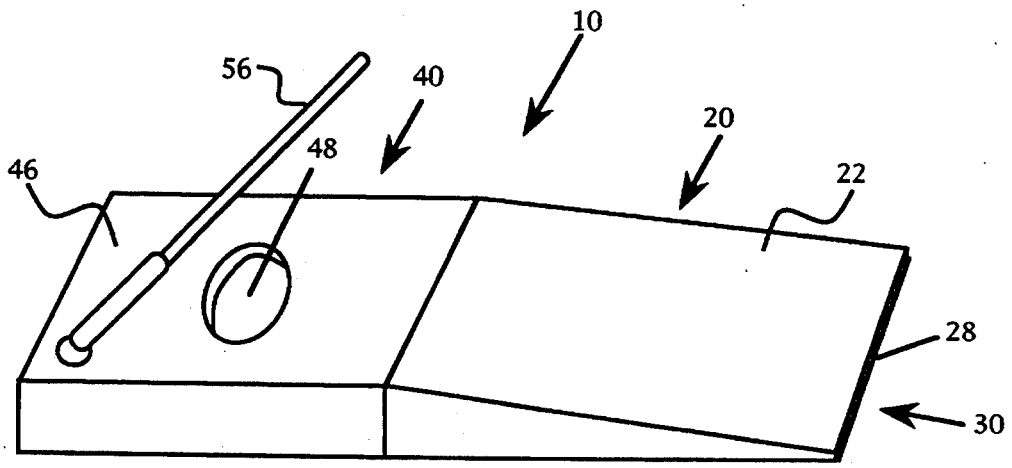
FIG. 2 is a perspective view of the combination ramp and base constructed according to the principles of the present invention illustrating their cooperation and alignment, as well as illustrating a conventional writing instrument mounted to the top of the base.
Figure 3:
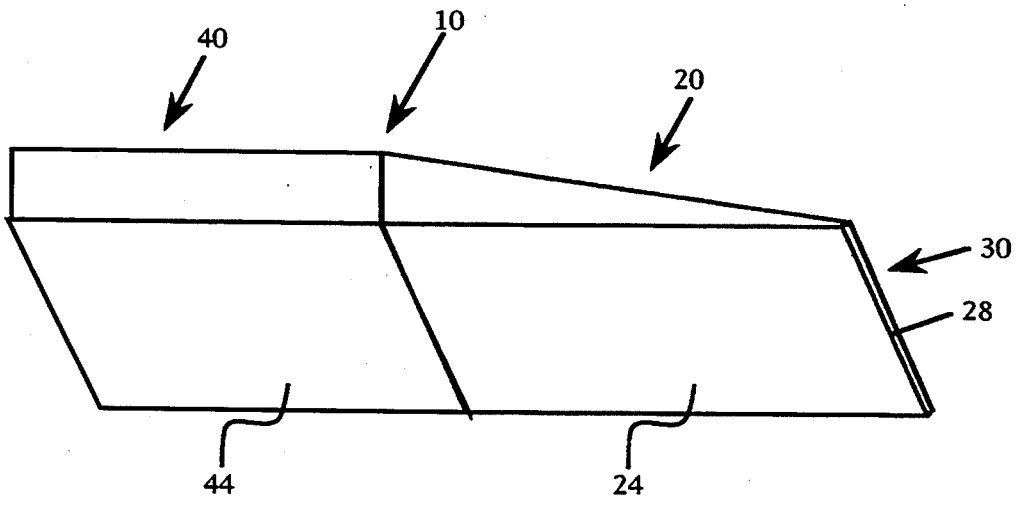
FIG. 3 is a perspective view of the bottom side of a base and the under side of a ramp constructed according to the principles of the present invention.

Referring now to the drawings in detail there is illustrated a preferred form of the golf putting and chipping trainer device in accordance with the principles of the present invention and designated generally in its entirety by the reference numeral 10 in FIGS. 1, 2, 3 & 6.

In the preferred embodiment, the device 10 is adapted for use with a conventional golf club 72 (not shown) and comprises a ramp 20 and a rectangular base 40 in combination with a substantially planar surface 82. The ramp 20 and base 40 are preferably constructed of wood. The surface 82 of the preferred embodiment is also constructed of wood and includes a felt covering 41. However, the present invention is not so limited and may incorporate a ramp 20, base 40 and surface 82 of any material construction.

Figure 4:
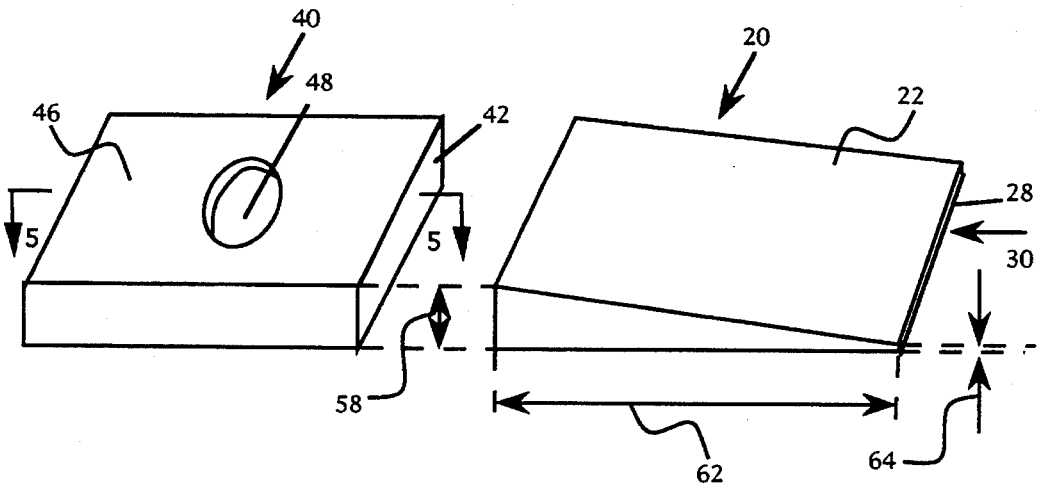
FIG. 4 is a perspective view of a separated base and ramp constructed according to the principles of the present invention.
Figure 5:
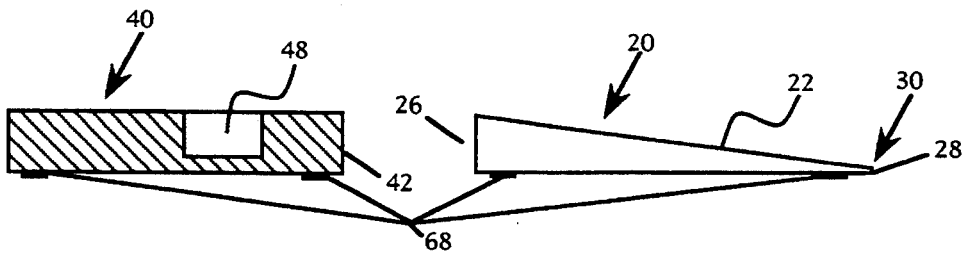
FIG. 5 is a cross-sectional view of a base taken along line 5—5 of FIG. 4 and a side view of a ramp constructed according to the principles of the present invention.

Referring now to FIGS. 1–6, the ramp 20 of the preferred embodiment has a face 22, an under side 24, a first end 26 and a second end 28. The second end 28 substantially defines an apex 30. The rectangular base 40 includes a first side 42, a bottom side 44, and a top side 46, as well as an annular aperture 48 simulating a golf cup. The first side 42 of the base 40 and the first end 26 of the ramp 40 have the same thickness and are cooperatively engaged. Although not shown, the preferred engagement means is tongue and groove cooperation, although any other conventional attachment means will clearly suffice. When used as a desk accessory, one or more novelties 56 are mountable to the top side 46 of the base 40. In the preferred embodiment of FIG. 1, a conventional writing instrument is employed, although the invention contemplates attachment of any other novelties, such as: memo pads, coasters for beverage containers, ash trays, any smoking accessories, golf or other sports memorabilia, engraved plates, and trophies of all sorts. The preferred embodiment also contains cushioning means 68 attached to the under side 24 of the ramp 20 and the bottom side 44 of the base 40, as shown in FIG. 5.

Referring now to FIG. 4, the ramp 40 of the preferred embodiment has a second thickness 64 which measures $\frac{1}{8}$ of an inch and a first thickness 58 of one inch. It also has a length 62 of $6\frac{1}{2}$ inches. An aperture 48 is centrally located on the base 40 and has a diameter of $3\frac{5}{8}$ inches. The center of the aperture 48 is disposed $2\frac{3}{4}$ inches laterally from the first side 42 of the base 40. In the preferred embodiment, the upward slope of the ramp is defined by an angle of approximately 7.668 degrees above horizontal. Although specific dimensions are disclosed in connection with the preferred embodiment, a ramp 40 of any shape, design, or construction which yields an upward slope which causes a golf ball 70, as shown in FIG. 1, to cease rolling at a point approximately 17 inches beyond the center of the aperture 48 when positioned on the surface 82 and propelled toward the ramp 20 in line with the aperture 48 at a predetermined rate of speed if the device were not present will suffice.

In the preferred embodiment, as shown in FIG. 1, the ramp 20 and base 40 are positioned, in combination, at a distal end 84 of the surface 82 with the apex 30 of the ramp 20 pointing toward a proximal end 86 of the surface 82. The surface 82 contains a pair of elongated guide members 92. The elongated guide members 92 are preferably constructed of wood and are detachably mounted on the surface 82 in horizontal spaced parallelism. The elongated guide members 92 extend vertically upward from and substantially perpendicular to the surface 82 providing laterally facing sidewalls 94. The elongated guide elements 92 may be attached to the surface 82 by any conventional attachment means 26. However, the preferred attachment means 26 consist of Velcro-type hook-and-loop material. The surface 82 of the preferred embodiment is preferably covered with felt which coacts with conventional hook-and-loop material attached to the bottom of the elongated guide elements 92, although it is to be understood by those skilled in the art that many suitable replacements are contemplated. The preferred embodiment of FIG. 1 also contains side rails 98 which abut and extend vertically upward from the periphery of the surface 82 and substantially perpendicular thereto. In the preferred embodiment the base 40 and ramp 20 are sized to fit on the surface 82 adjacent the side rails 98.

The face 22 of the ramp 20 could also include a laser engraved logo 59, although it will be understood that other methods of engraving or marking will suffice. The device 10 could also include conventional leveler means (not shown) which act to level or tilt the surface 82. In the preferred embodiment, the leveler means include screw-type lift mechanisms disposed on the bottom of the surface 82 adjacent each of its four corners.

To illustrate the invention, FIG. I shows a preferred embodiment illustrating two positions of the elongated guide members 92 and the combination ramp 20 and base 40 which is removed from the surface 82 for separate use as a trainer or as a desk accessory.

Figure 6:
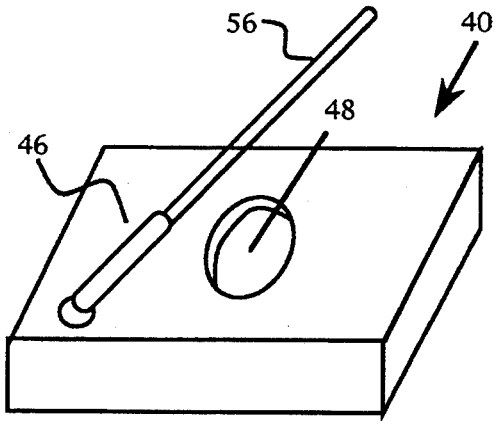
FIG. 6 is a perspective view of a base constructed according to the principles of the present invention in combination with a conventional writing instrument.

FIG. 6 illustrates the base 40 in combination with novelty 56, which is a conventional writing instrument.

OPERATION

In operation, the device 10, including the surface 82, ramp 20 and base 40, is placed on the ground. The elongated guide members 92 are then attached to the surface 82 parallel to the desired path of the golf ball 70 which is placed intermediate the elongated guide members 92 on the surface 82. A golfer then assumes a position with his or her feet equidistant from the device 10, places a golf club 72 intermediate the elongated guide members 92 and substantially adjacent their facing sidewalls 94.

In such arrangement, the golf ball 70 positioned on the surface 92 may be struck by the golf club and propelled toward the ramp 20, base 40 and aperture 48. The elongated guide members 92 may be moved laterally and horizontally to provide practice from different lengths and employing different golf clubs. As the golfer repeats this process, he or she will develop a natural, conditioned motor nervous response to consistently employ the desired putting stroke even when the device 10 is not being used.

The ramp 20 and base 40 may also be employed as a putting and chipping trainer without the surface 82, elongated guide members 92 and side rails 98. In operation, the combination ramp 20 and base 40 are placed on the ground.

In addition, the combination ramp 20 and base 40, or the base 40 alone, may have one or more ornamental or utilitarian novelties 56 attached to the top side 46 of the base 40. As such, it may be employed as a desk accessory.

In view of the above, it will be seen that the several objects of this invention are achieved and other advantageous results are obtained.

While the invention has been described in connection with a preferred embodiment, it will be understood that it is not intended that the invention be limited to that embodiment. On the contrary, it is intended to cover all alternatives, modifications and equivalents as may be included within the spirit and scope of the invention as defined by the appended claims.

I claim:

1. A combination golf putting and chipping trainer and desk accessory device, said device comprising, in combination:

a ramp having a face, an under side, a first end and a second end, said second end substantially defining an apex;

a rectangular base having a first side, a bottom side, and a top side, said top side having an annular aperture simulating a golf putting cup located therein, said first side of said base and said first end of said ramp having a first thickness and being cooperatively engaged; said aperture having a center and said face of said ramp having an upward slope from said second end to said first end such that a golf ball which is propelled toward said ramp in line with said aperture at a predetermined rate of speed would cease rolling at a point approximately 17 inches beyond said center of said aperture if said device was not present; and one or more novelties mountable to said top side of said base, whereby said device may be used on top of a desk as a desk accessory when not being used as a golf putting and chipping trainer.

2. The device of claim 1 further comprising a logo having characteristics of being laser-engraved on said face of said ramp.

3. The device of claim 3 wherein said aperture has a diameter of $3\frac{5}{8}$ inches, said center of said aperture is disposed $2\mu$ inches laterally from said first side, said first thickness equals one inch, and said ramp has a length of $6\frac{1}{2}$ inches, and a second thickness of $\frac{1}{8}$ inch, whereby said upward slope of said face of said ramp is defined by an angle of approximately 7.668 degrees above horizontal.

4. The device of claim 1 adapted for use in combination with a substantially planar putting and chipping surface, said surface having a distal end and a proximal end, said ramp and said base being disposed, in combination, on said surface proximate said distal end with said apex of said ramp pointing toward said proximal end of said surface, wherein a golf ball positioned on said surface intermediate said ramp and said proximal end of said surface may be struck by a golf club and propelled toward said ramp and in line with said aperture.

5. The device of claim 4 wherein said aperture has a diameter of $3\frac{5}{8}$ inches, said center of said aperture is disposed $2\frac{3}{4}$ inches laterally from said first side, said first thickness equals one inch, and said ramp has a length of $6\frac{1}{2}$ inches, and a second thickness of $\frac{1}{8}$ inch, whereby said upward slope of said face of said ramp is defined by an angle of approximately 7.668 degrees above horizontal.

6. The device of claim 4 further comprising a pair of elongated guide members disposed in horizontal spaced parallelism on said surface and extending vertically upward therefrom and substantially perpendicular to said second end of said ramp and adapted to receive said golf club intermediate therebetween adjacent laterally facing sidewalls of said elongated guide members, whereby said golf club may be translated intermediate said elongated guide members in guided fashion to strike said golf ball positioned intermediate said elongated guide members.

7. The device of claim 8 wherein said elongated guide members comprise attachment means for removably affixing said elongated guide members on said surface allowing horizontal translation of said elongated guide members along said surface, whereby putts of varying lengths may be attempted, and lateral translation of said elongated guide members with respect to each other, whereby golf clubs of various widths may be employed with the device.

8. The device of claim 4 further comprising one or more side rails abutting and extending vertically upward from the periphery of said surface and substantially perpendicular to said surface.

9. The device of claim 5 further comprising leveler means attached to said under side of said ramp and said bottom side of said base.

10. A combination golf putting and chipping trainer and desk accessory device, said device comprising, in combination:

a ramp having a face, an under side, a first end and a second end, said second end substantially defining an apex;

a rectangular base having a first side, a bottom side, and a top side, said top side having an annular aperture simulating a golf putting cup located therein, said first side of said base and said first end of said ramp having a first thickness and being cooperatively and detachably engaged; said aperture having a center and said face of said ramp having an upward slope from said second end to said first end such that a golf ball which is propelled toward said ramp in line with said aperture at a predetermined rate of speed would cease rolling at a point approximately 17 inches beyond said center of said aperture if said device was not present; and one or more novelties mountable to said top side of said base, whereby said base may be used on top of a desk as a desk accessory when not being used as a golf putting and chipping trainer.

11. The device of claim 10 wherein said aperture has a diameter of $3\frac{5}{8}$ inches, said center of said aperture is disposed $2\frac{3}{4}$ inches laterally from said first side, said first thickness equals one inch, and said ramp has a length of $6\frac{1}{2}$ inches, and a second thickness of $\frac{1}{8}$ inch, whereby said upward slope of said face of said ramp is defined by an angle of approximately 7.668 degrees above horizontal.

12. The device of claim 10 adapted for use in combination with a substantially planar putting and chipping surface, said surface having a distal end and a proximal end, said ramp and said base being disposed, in combination, on said surface proximate said distal end with said apex of said ramp pointing toward said proximal end of said surface, wherein a golf ball positioned on said surface intermediate said ramp and said proximal end of said surface may be struck by a golf club and propelled toward said ramp and in line with said aperture.

13. The device of claim 12 wherein said aperture has a diameter of $3\frac{5}{8}$ inches, said center of said aperture is disposed $2\frac{3}{4}$ inches laterally from said first side, said first thickness equals one inch, and said ramp has a length of $6\frac{1}{2}$ inches, and a second thickness of $\frac{1}{8}$ inch, whereby said upward slope of said face of said ramp is defined by an angle of approximately 7.668 degrees above horizontal.

14. The device of claim 12 further comprising a pair of elongated guide members disposed in horizontal spaced parallelism on said surface and extending vertically upward therefrom and substantially perpendicular to said second end of said ramp and adapted to receive a golf club intermediate therebetween adjacent laterally facing sidewalls of said elongated guide members, whereby said golf club may be translated intermediate said elongated guide members in guided fashion to strike a golf ball positioned intermediate said elongated guide members.

15. The device of claim 14 wherein said elongated guide members comprise attachment means for removably affixing said elongated guide members on said surface allowing horizontal translation of said elongated guide members along said surface, whereby putts of varying lengths may be attempted, and lateral translation of said elongated guide members with respect to each other, whereby golf clubs of various widths may be employed with the device.

16. The device of claim 12 further comprising one or more side rails abutting and extending vertically upward from the periphery of said surface and substantially perpendicular to said surface.

* * * * *